United States Patent [19]

Rashev et al.

[11] 4,307,263

[45] Dec. 22, 1981

[54] DEVICE FOR BALANCING THE FORCES ACTING ON THE ELECTRODE IN ELECTRO-SLAG FURNACES

[75] Inventors: Tzolo V. Rashev; Ivanka A. Rasheva; Konstantin S. Milchev; Yordan G. Lambev, all of Sofia, Bulgaria

[73] Assignee: Institute po Metaloznanie i Technologia na Metalite, Sofia, Bulgaria

[21] Appl. No.: 950,578

[22] Filed: Oct. 12, 1978

[30] Foreign Application Priority Data

Oct. 14, 1977 [BG] Bulgaria ..... 37578

[51] Int. Cl.[3] ..... H05B 3/60

[52] U.S. Cl. ..... 13/9 ES; 13/31 R

[58] Field of Search ..... 13/9 ES, 13, 14, 31

[56] References Cited

U.S. PATENT DOCUMENTS

| | | | |
|---|---|---|---|
| 3,614,284 | 10/1971 | Scheidig et al. | 13/13 |
| 3,823,243 | 7/1974 | Vitale et al. | 13/13 |
| 3,914,526 | 10/1975 | Markarian et al. | 13/13 |

*Primary Examiner*—Roy N. Envall, Jr.
*Attorney, Agent, or Firm*—Karl F. Ross

[57] ABSTRACT

An electroslag-furnace electrode balancing system in which a pair of double-acting cylinders is connected by a flexible cable passing over pulleys mounted on the electrode carrier, the cylinders being selectively connected to ambient and furnace pressure so that the applied gas pressure balances the pressures to which the electrode may be subject in the furnace.

3 Claims, 1 Drawing Figure

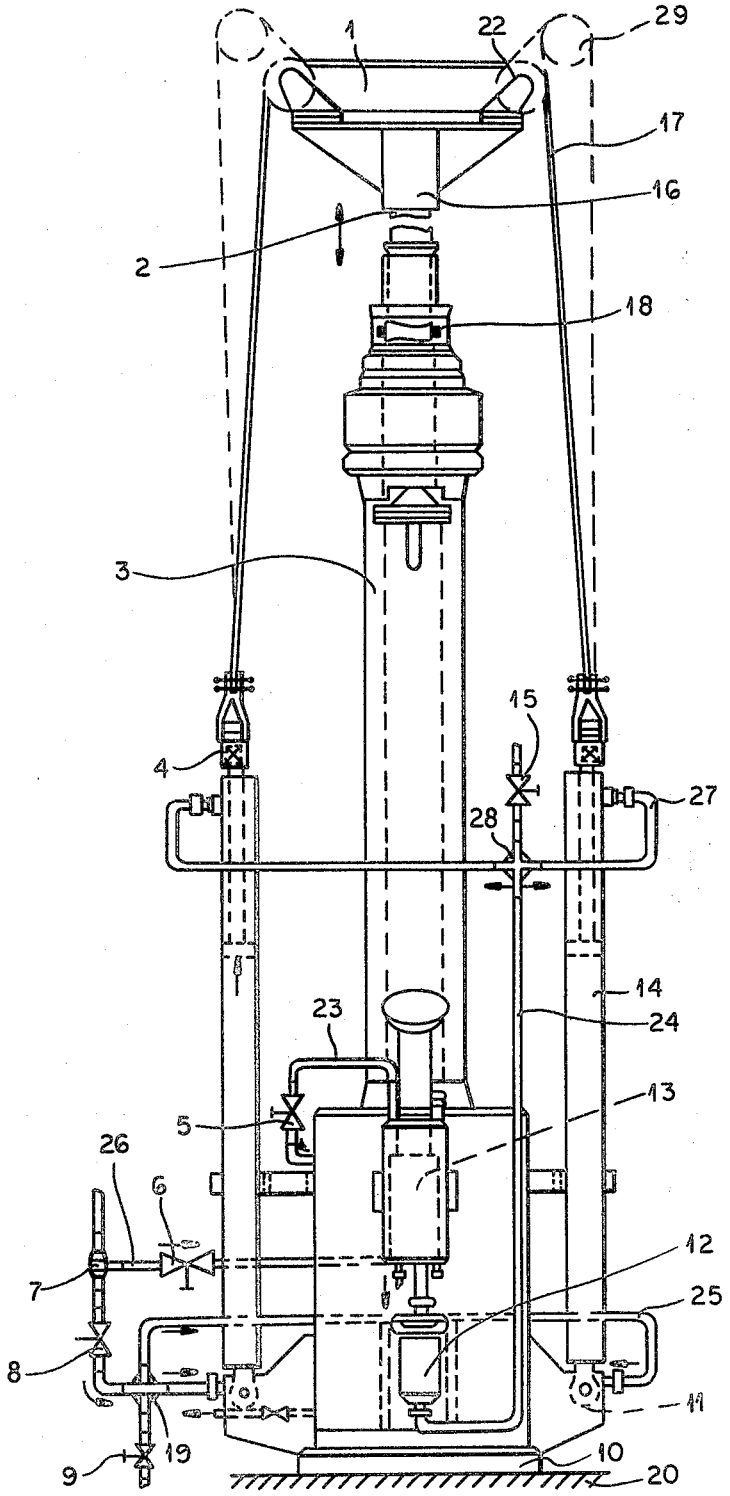
1
22
29
17
16
2
18
3
15
4
27
28
14
23
24
13
5
26
6
12
7
25
8
11
19
9
10
20

DEVICE FOR BALANCING THE FORCES ACTING ON THE ELECTRODE IN ELECTRO-SLAG FURNACES

FIELD OF THE INVENTION

This invention relates to a device for balancing the forces acting on the electrode in electro-slag furnaces and, more particularly in the case of casting in melting chambers under pressure.

BACKGROUND OF THE INVENTION

There are known mechanical, hydraulic and pneumatic devices for carrying and feeding an electrode into a furnace in the classic process of electroslag metal remelting, without forced increase of the pressure inside the melting chamber. These devices are not self-regulable in response to the pressure inside the melting chambers of the furnace and their basic drawback is the inaccuracy in balancing, caused by the individual driving pulses, not controlled directly by the melting process.

There are not known any devices for self-regulation of the feeding force of the electrode in direct response to the pressure inside the melting chamber of electroslag furnaces. Electroslag remelting of metal by the classic process in an inert gas medium requires a more sensitive maintainance of the melting process, which depends directly on the balancing of forces on the electrode, which maintains the metal bath in a molten state.

OBJECT OF THE INVENTION

It is, therefore, a general object of the invention to provide an improved device for balancing the forces acting on the electrode in electroslag furnaces which will obviate the above-mentioned drawbacks.

SUMMARY OF THE INVENTION

This object is achieved by a device for balancing the forces acting on the electrode in electroslag furnaces, in which, to the base of the housing there are mounted actuating cylinders, to the upper end of which there is fastened an elastic member connected to a cross-bar disposed over the upper end of the electrode. The elastic member can be a steel cable, which passes over pulleys attached to the cross-bar. The interior of the housing is connected in succession by an outlet pipe conduit, a cooler, a filter and pipe conduits to the upper end of the actuating cylinders, while their lower end is connected through an outlet pipe conduit and a four-way junction to the atmosphere and the gas main supply line. The actuating cylinders are pneumatic and double-acting.

The advantages of the device of the present invention lie in that, for balancing the forces acting on the electrode, the pressure of the medium proper of the melting chamber of the furnace is used; conditions are provided for self-regulation of these forces without the need of additional instruments and devices, thus avoiding inconveniences and inaccuracies; conditions for precise and safe operation are provided.

BRIEF DESCRIPTION OF THE DRAWING

For a better understanding of the invention, reference should be made to the sole FIGURE of the accompanying drawing, in which there is illustrated an elevational view of a preferred embodiment of the invention.

SPECIFIC DESCRIPTION

The device for balancing the forces acting on the electrode in electroslag furnaces comprises pneumatic cylinders 14, mounted on the housing 3 at their lower ends 11, while their upper ends are connected by means of connectors 4, to a steel cable 17, passing over pulleys 22 attached to cross-bar 1, which is disposed over the upper end of the electrode 2 and is connected with the electrode carrier 16, the electrode 2 being embraced concentrically by housing 3 with a seal 18 disposed therebetween.

By means of outlet pipe conduit 23, housing 3 is connected to a cooler 13 and a filter 12, which is connected through the pipe conduits 24 and 27 to the pneumatic cylinders 14 at their upper ends. The lower ends of cylinders 14 are connected to the atmosphere and the gas main supply line through an outlet pipe conduit 25 and a four-way junction 19.

The operation of the device in accordance with the invention is as follows:

Electrode 2 is installed in the housing 3; it is clamped by the electrode carrier 16, and then the housing is either filled with gas or is degassed. Gas is delivered by the gas main supply line through a reducing valve not shown, the three-way junction 7, the open valve 6 and the pipe conduit 26 to the housing 3. From there the gas passes through pipe conduit 23 and the open valve 5 and enters the cooler 13, where the heated gas is cooled and passed through filter 12, where it is filtered, and through pipe conduits 24 and 27 and the four-way junction 28 and enters the upper end of the pneumatic cylinders 14. Valve 15 is in the closed position. In the beginning of the process, the upper end of the electrode is in its most distant position from the bottom plate 10 which rests on the base-plate 20, while the piston rods of the pneumatic cylinders are pulled in their upper end position.

The gas, entering the pneumatic cylinders 14, begins to act on the upper side of the pistons, forcing them to travel downwardly. They, on their part, pull the steel cable 17, and the force is transmitted by the pulleys 22 to the cross-bar 1, and from there to the upper side of the journal of electrode 2, in a direction opposite and equal to the force produced by the action of the gas on the face of the electrode. The sum of the working area of the pistons is chosen so as to be equal to the cross-section of electrode 2. There remains to act on the current-supplying electrode carrier only the working force of the machine, i.e. the weight of the electrode and the cross-bar or some other displaced means.

During operation, valve 9 is open, while valve 8 is closed. This permits the gases below the piston of the pneumatic cylinder to escape freely from the space below the piston. In the opposite case, i.e. when there is no melting, in accordance with the technological process, the pressure over the pistons of the pneumatic cylinders 14 is not increased. When loading a new electrode, the piston rods of the pneumatic cylinders must be raised in their upper end position. For this reason valves 8 and 15 are opened, while valves 6 and 9 are closed, allowing the gas to be delivered to the lower inlets of the pneumatic cylinders, its action raising the piston rods to their upper end position.

When the electroslag furnace is operating under vacuum, the layout remains in principle the same. Only the seals and the lubrication are replaced. Another difference is that the vacuum is on the lower side of the pistons of the pneumatic cylinders 14, while the upper side is connected to the atmosphere and the steel cable 17 passes over additional pulleys 29, which reverse the motion.

What we claim is:

1. A device for balancing the forces acting on the electrode in an electroslag furnace comprising:

a housing centered on an upright axis;

a vertically displaceable electrode centered on said axis and positioned in said housing with a seal disposed between said electrode and said housing;

a cross-bar disposed above said electrode and formed with an electrode carrier secured to the upper end of said electrode;

a pair of double-acting upright pneumatic cylinders flanking said housing and attached thereto at the lower ends thereof;

means on said cylinders for securing a cable to the pistons thereof, said cable passing over pulleys provided on said cross-bar;

a first inlet pipe communicating with the interior of said housing for feeding gas from a gas supply thereinto, said first inlet pipe being provided with a first shutoff valve;

an outlet pipe communicating with the interior of said housing and the upper ends of said cylinders for feeding heated gas from said housing into said cylinders, whereby the pressure in said cylinders is equalized with the pressure in said housing, said outlet pipe being provided with a second shutoff valve;

a second inlet pipe communicating with the lower ends of said cylinders for feeding gas from said gas supply thereinto, said second inlet pipe being provided with a third shutoff valve;

a fourth shutoff valve communicating with the upper ends of said cylinders for selectively venting same to ambient atmospheric pressure; and a fifth shutoff valve communicating with the lower ends of said cylinders for selectively venting same to ambient atmospheric pressure.

2. The device defined in claim 1 further comprising:

a cooler connected to said outlet pipe for cooling said heated gas traversing same; and a filter connected to said outlet pipe for filtering the gas from said housing.

3. The device defined in claim 2, wherein the sum of the cross-sectional areas of said cylinders is equal to the cross-sectional area of said electrode.

* * * * *